United States Patent [19]

Thornbery et al.

[11] 4,065,939

[45] Jan. 3, 1978

[54] COMBINATION VALVE

[75] Inventors: James M. Thornbery, Milwaukee; Charles D. Orth, Cedarburg, both of Wis.

[73] Assignee: The Singer Company, New York, N.Y.

[21] Appl. No.: 653,897

[22] Filed: Jan. 30, 1976

[51] Int. Cl.[2] ..... F25B 41/04

[52] U.S. Cl. ..... 62/217; 236/92 B

[58] Field of Search ..... 62/217, 204; 236/92 B

[56] References Cited

U.S. PATENT DOCUMENTS

| | | | |
|---|---|---|---|
| 3,537,645 | 11/1970 | Treder | 62/204 |
| 3,691,783 | 8/1972 | Proctor | 62/217 |
| 3,810,366 | 5/1974 | Orth | 62/217 |
| 3,810,488 | 5/1974 | Orth et al. | 62/217 |
| 3,899,897 | 8/1975 | Boerger et al. | 62/217 |

*Primary Examiner*—William E. Wayner
*Assistant Examiner*—R. J. Charvat
*Attorney, Agent, or Firm*—Michael, Best & Friedrich

[57] ABSTRACT

The novelty is the low cost, versatile manner of mounting an evaporator pressure regulator valve (EPR) on a thermostatic expansion valve (TXV) to provide a compact combination valve. The TXV controls refrigerant flow to the evaporator in accordance with the pressure acting below the diaphragm and the temperature influencing the temperature responsive charged space above the diaphragm. The rider pin connecting the diaphragm to the valve is hollowed out so that the bottom of the hole in the rider pin is in the refrigerant return flow path. A restrictor is placed in the upper end of the rider pin to prevent migration of condensed refrigerant to the head chamber in the event the valve is mounted upside down. A sleeve of low thermal conductivity positioned around the rider pin where it passes through the return conduit damps temperature changes and reduces valve hunting. The EPR threads into the TXV outlet. The interior of the bellows is sealed at atmospheric pressure so the pressure on the outside of the bellows is resisted by the atmospheric pressure within the bellows as well as by the spring. When the pressure on the outside of the bellows (which is evaporator pressure in a refrigeration system) exceeds a predetermined amount, the bellows tends to collapse and the head of the bellows pulls away from the actuating pin to open the pilot valve, allowing the piston to move to the right and thus open the outlet. When the pressure falls below the desired amount, the bellows expands and moves the head of the bellows against the actuating pin to close the pilot valve. Flow through the bleed hole in the end of the piston to the pilot valve chamber rapidly raises the pressure therein so that the return spring can move the piston to close the outlet. An adapter plate is bolted to the standard TXV and carries a dome-shaped member to house the EPR and the suction line is brazed to the dome.

5 Claims, 4 Drawing Figures

COMBINATION VALVE

BACKGROUND OF THE INVENTION

U.S. Pat. No. 3,810,366 shows a combination valve which permitted use of an EPR such as shown in U.S. Pat. No. 3,810,488 in a single body incorporating the TXV shown in U.S. Pat. No. 3,537,645. This had the drawback that special production was required and the physical size was somewhat large.

SUMMARY OF THE INVENTION

The object of this invention is to permit combination of a standard EPR with a standard TXV with minimal cost or size penalty. The construction yields greater flexibility of mounting, simplicity of tooling change, and standardization with existing parts for field replacement. Existing assembly and test fixtures can be readily adapted to the modified valves. This invention is not restricted to use of a specific EPR or a specific TXV.

DESCRIPTION OF THE PREFERRED EMBODIMENT

Figure 1:
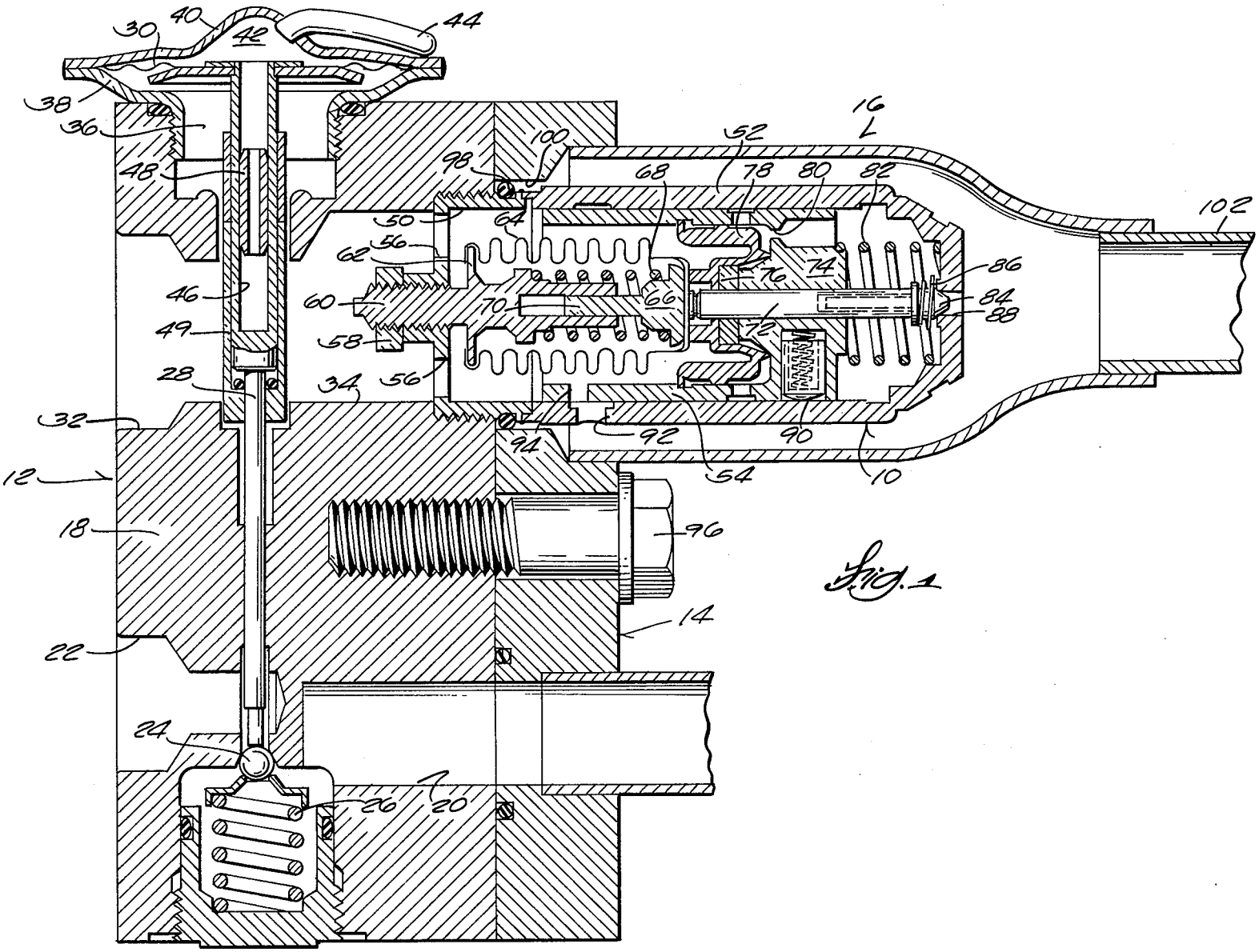
FIG. 1 is a vertical section through the combination valve.

In FIG. 1 the EPR valve assembly 10 is threaded into the return outlet of the TXV 12 and the adapter plate 14 carrying the dome-shaped member 16 is bolted to the TXV body. The TXV 12 has a body 18 provided with an inlet 20 and an outlet 22. The ball-type valve 24 is biased by compressed spring 26 towards its seat and is actuated by rider pin 28 which transmits motion from the diaphragm 30 to the valve. When the valve is open, it permits refrigerant flow from outlet 22 to the evaporator. Refrigerant leaving the evaporator enters port 32 and flows past the rider pin to conduit 34.

In the form shown in FIG. 1 pressure in the return line is felt in chamber 36 on the underside of the diaphragm due to the clearance provided around the rider pin. The diaphragm is housed in the head assembly comprised of lower stamping 38 threaded into the upper end of the valve body and an upper stamping 40 welded to the lower stamping. The temperature responsive chamber 42 between the diaphragm and the upper head stamping is charged with a temperature responsive charge through capillary 44 which is then pinched off and sealed. The rider pin is hollowed out by means of bore 46 so the lower end of the bore is in the return flow path and senses that temperature. The plug insert 48 is provided with a small opening which prevents condensate from moving out of the bottom of the bore in the rider pin and into the head assembly. Thus the refrigerant condensate in the thermal charge will remain in the space to be sensed, i.e., the return flow path. The sleeve 49 on the outside of the rider pin impedes thermal response of the rider pin to temperature fluctuations and thus damps response of the valve.

Further details of the TXV described above may be obtained by reference to U.S. Pat. No. 3,537,645. The specific details of this TXV are not important to this invention but the fact that this valve design does provide a return flow path through the valve body makes it admirably suited to adaptation to the present combination valve.

EPR valve 10 is a separate and distinct subassembly and differs from what would otherwise be a standard unit by having a threaded adapter 50 welded to cylinder 52 to permit mounting the EPR in the return line 34 of the TXV. Piston 54 is mounted inside the cylinder 52. The threaded adapter 50 is provided with multiple inlet ports 56 and has a central internally threaded boss 58 through which the threaded stem 60 of the bellows support 62 projects. Bellows 64 is secured to the support 62 and the right, closed end of the bellows encloses pad 66 which serves as a seat for spring 68 inside the bellows. The pad 66 has a guide stem 70 which is received inside the blind hole in the bellows support member. The space inside the bellows is at atmospheric pressure when it is sealed. Thus the pressure on the outside of the bellows is resisted by atmospheric pressure within the bellows and by the spring and by the spring effect of the bellows itself. The degree of compression of the spring is determined by turning the threaded stem 60 to determine the response pressure.

The bellows assembly acts against the left end of actuating pin 72 which passes through the head 74 of the piston. The felt wiper 76 keeps the pin free of dirt and is retained in position by the filter screen assembly 78 which prevents dirt from migrating to the bleed hole 80. The piston is urged to the left by spring 82. Pin 72 supports the stem of pilot valve 84 and spring 86 urges the pilot valve into the pin 72 and urges the valve in the opening direction. The pilot valve controls flow through port 88. Friction of the piston in the cylinder is controlled by the spring loaded friction button 90.

In the position shown, the EPR valve is closed by reason of the piston covering the slot 92 in the cylinder wall but a limited flow can take place through hole 94 in the piston skirt which is in FIG. 1 aligned with slot 92. This will insure adequate flow to the compressor to lubricate the compressor and prevent overheating. In the illustrated position the pressure in the pilot chamber between the piston head and the end of the cylinder is at the same pressure as the inlet by reason of the fact that flow can occur through the bleed hole 80. As the inlet pressure tends to build up it will collapse the bellows which will cause the bellows to move to the left and allow pin 72 to move to the left under influence of spring 86. This will permit flow from the pilot chamber through the port 88 and if the opening is sufficient, i.e. greater than permitted by the bleed 80, the pressure in the pilot chamber drops causing a pressure differential to exist across the piston head to move the piston head to the right against the force of spring 82 and move the left end of the piston past the slot 92 in the cylinder. When the inlet pressure drops, the reverse will occur. Further details of this operation can be ascertained by reference to U.S. Pat. No. 3,810,488.

For the present invention the important consideration relative to the EPR is that this unit 10 passes the flow through the valve to the outside of the unit 10 and this must, of course, be contained. The flow leaving the valve either through slot 92 or the pilot opening 88 enters the space between the dome member 16 and the unit 10. The dome 16 is brazed to mounting plate 14 which is secured to the TXV 12 by bolt 96. An O-ring 98 is provided between the threaded adapter 50 and the bore 100 in the mounting plate 14 to seal against leakage. The dome necks down to connect to the suction line conduit 102, this being a brazed joint.

With the simple modification of the TXV and the EPR valve to provide for a threaded connection and the use of the dome to contain the flow leaving the EPR valve, a combination valve has resulted. The dome 16 is a simple drawn part and, as will appear, the outlet from the dome can be taken off at any desired angle to tailor the combination valve to the space and layout requirements of the customer.

In the construction shown in FIG. 1 the space in chamber 36 below the diaphragm is at the same pressure as the flow passing the rider pin. This is used in conventional refrigeration circuits using tube and fin coils. If the valve is to be used in a flooded evaporator system it is desirable to sense the pressure downstream of the EPR valve. The arrangement shown in FIG. 2 accomplishes this by providing a sealing member 104 snugly fitted about the damping sleeve 49 and pressed against seat 106 in chamber 36 to seal the chamber 36 from the return conduit 32, 34. The sealing member 104 is spring loaded by spring 108, the upper end of which is seated against spring seat 110 fixed on the drawn neck of the lower head stamping 38. Having thus sealed chamber 36 from the pressure in the return line, the conduit 112 is provided to lead to the space between EPR 10 and dome 114. It will be noted in this instance the dome 114 is provided with a lateral adapter 116 leading to the suction line 102. This is to illustrate the versatility of the dome by way of accommodating various installation requirements.

Figure 3:
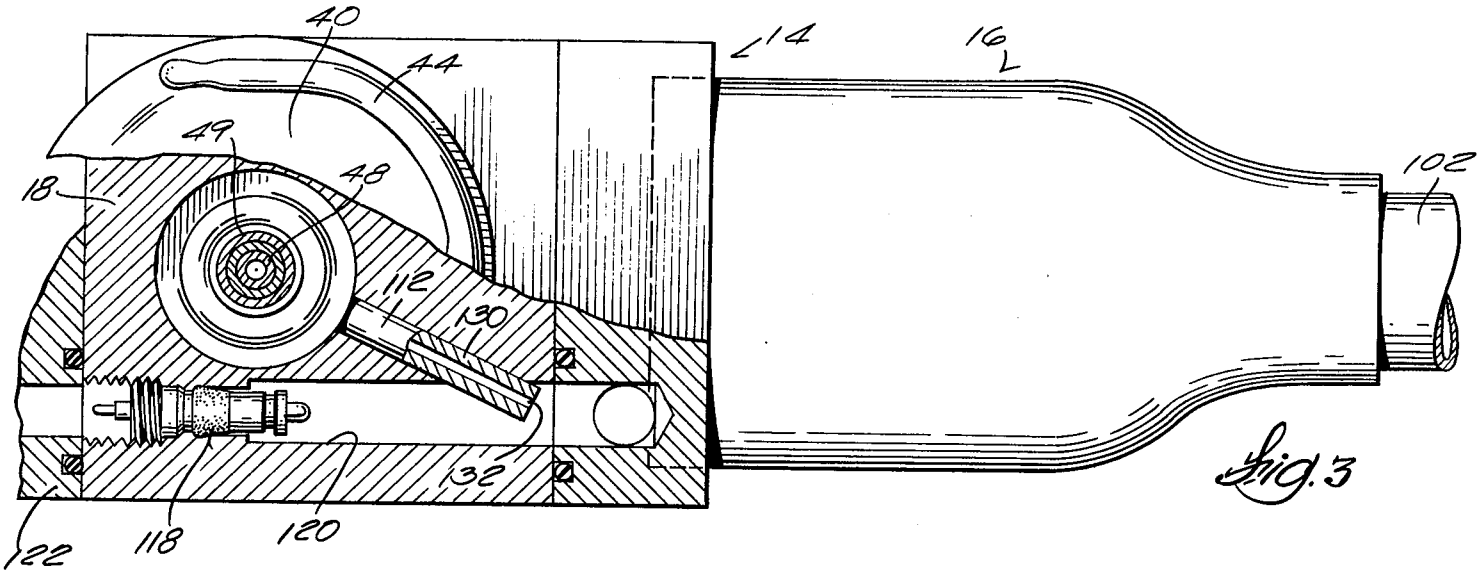
FIG. 3 is a horizontal section showing the manner in which a relief valve may be incorporated in the standard TXV body and also shows a pressure pulsation damper in the conduit between the underside of the diaphragm and the EPR outlet.
Figure 4:
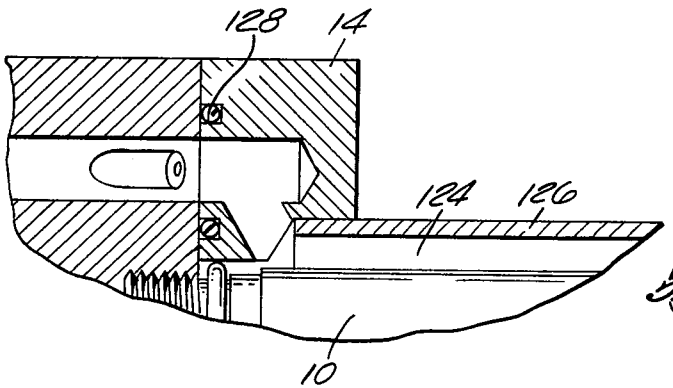
FIG. 4 is a section on line 4—4 in FIG. 3.

FIG. 3 illustrates the manner in which the basic TXV body 18 can be modified to accommodate the relief valve 118 threaded into conduit 120. The relief valve per se is a conventional unit and functions to return oil from the evaporator as well as relieving the evaporator. The conduit 120, of course, requires corresponding connections built into the evaporator flange plate 122 at the left end of the conduit 120. The right end of the conduit communicates with the mounting plate 14 and the space 124 between the EPR 10 and the dome 126. This connection is provided with a suitable O-ring seal 128.

Figure 2:
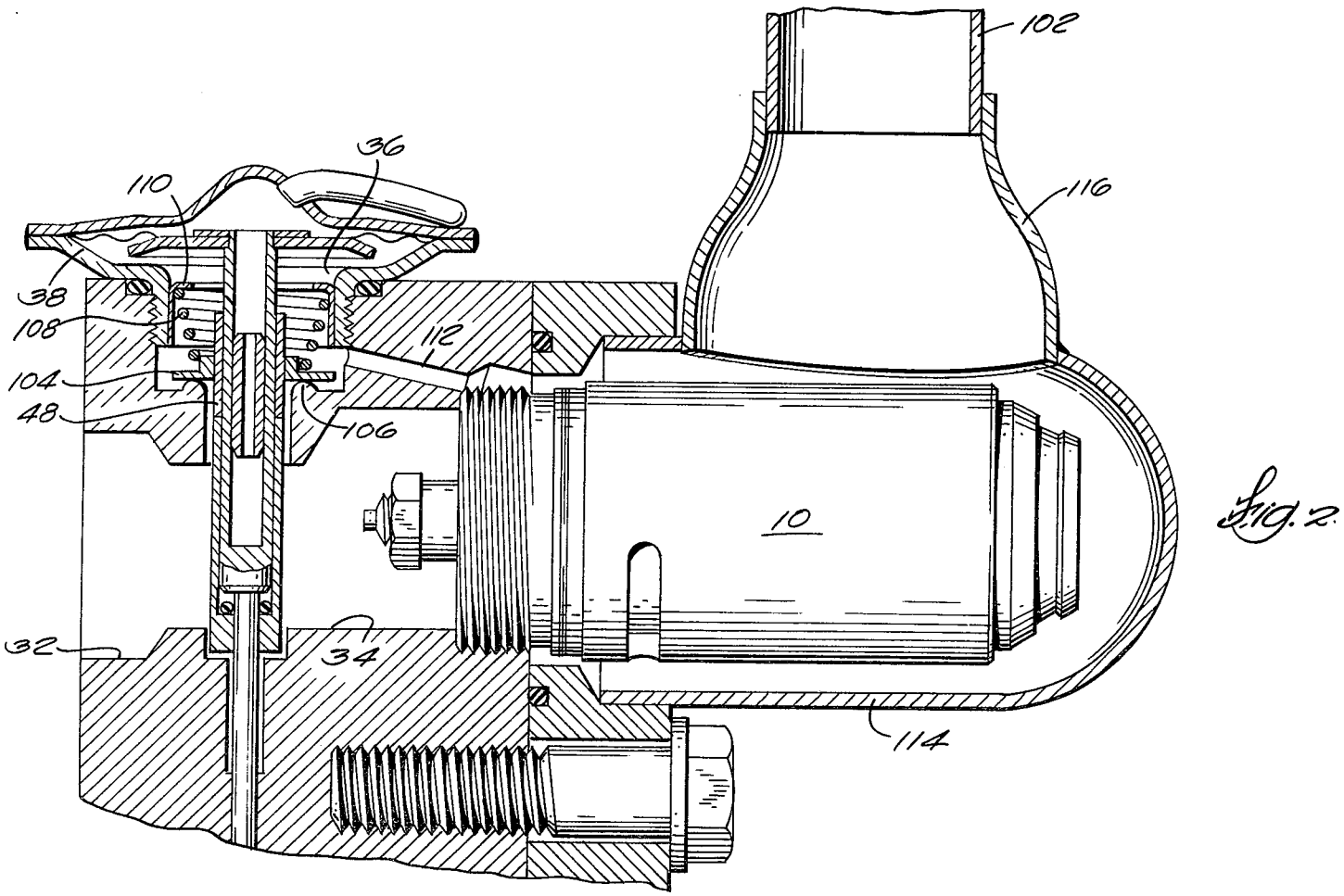
FIG. 2 is an enlarged fragmentary vertical section showing a modified form in which the pressure under the diaphragm is the pressure downstream of the EPR and the suction line comes off the side of the dome.

A further feature is shown in FIG. 3 in connection with the line comparable to 112 in FIG. 2 leading from the space under the diaphragm to the space between the EPR and the dome 126. It will be noted there is a plug 130 provided in this line. The plug has a small opening 132 therethrough. By providing this small opening (i.e., smaller than can be practically drilled through the valve body for the total length of the conduit 112) it is possible to damp the pressure pulsations normally obtaining in the suction line and thus prevent false response of the diaphragm caused by these pressure pulsations. Absent the damping plug 130, the diaphragm can experience hunting or cycling problems in some systems.

We claim:

1. A combination valve assembly for regulating refrigerant flow comprising, a thermostatic expansion valve (TXV) having a body provided with an inlet and an outlet and a valve regulating flow from the inlet to the outlet, a return flow conduit through said body, an evaporator pressure regulating valve (EPR) having a body provided with an inlet at one end and a pressure sensitive valve arrangement in the body controlling flow from the inlet to the exterior of the body, the inlet end of said EPR being threaded into the TXV body in communication with the outlet of the return flow conduit with the EPR projecting from the TXV body, a flat mounting plate fixed on the TXV body and having an aperture through which the EPR projects, a drawn dome-like housing enclosing the portion of the EPR projecting through said plate aperture and sealingly fixed to said plate to form a chamber receiving the flow from the EPR, and an outlet from the dome-like housing.

2. A combination valve assembly according to claim 1 in which the TXV includes a diaphragm operatively connected to said valve and having a first chamber on one side the pressure of which varies with temperature in the return line and having a second chamber on the opposite side, and a conduit leading from the second chamber to the space between said housing and said EPR.

3. A combination valve assembly according to claim 2 including a plug mounted in the last named conduit and provided with a restricted passage.

4. a combination valve assembly according to claim 2 in which the diaphragm is operatively connected to the valve by means of a rider pin which is hollowed out to provide a chamber located in the flow in said return conduit and communicating with said first chamber, said pin passing through said second chamber, and seal means preventing flow from said return conduit to said second chamber.

5. A combination valve assembly according to claim 2 including a relief conduit through the TXV body terminating in the space between the EPR and said housing, and a relief valve mounted in the relief conduit.

* * * * *